United States Patent [19]

Sonneville

[11] 4,066,212

[45] Jan. 3, 1978

[54] SPRING RAIL CLIP WITH TIGHTENING LIMITING FEATURE

[76] Inventor: Roger Paul Sonneville, 5, rue Maurice Ravel, 92210 Saint-Cloud, France

[21] Appl. No.: 694,036

[22] Filed: June 8, 1976

[30] Foreign Application Priority Data

June 26, 1975 France ..... 75.20068

[51] Int. Cl.[2] ..... E01B 9/30

[52] U.S. Cl. ..... 238/349; 238/351; 238/372

[58] Field of Search ..... 238/283, 310, 315, 349, 238/351, 372

[56] References Cited

U.S. PATENT DOCUMENTS

| | | | |
|---|---|---|---|
| 3,458,132 | 7/1969 | Newton | 238/349 |
| 3,519,205 | 7/1970 | Monclin et al. | 238/349 X |
| 3,587,965 | 6/1971 | Newton | 238/349 |
| 3,610,526 | 10/1971 | Burwell | 238/349 |
| 3,688,984 | 9/1972 | Sonneville | 238/349 |
| 4,003,517 | 1/1977 | Duchemin | 238/349 |

FOREIGN PATENT DOCUMENTS

| | | | |
|---|---|---|---|
| 2,225,220 | 5/1972 | Germany | 238/349 |
| 972,678 | 10/1964 | United Kingdom | 238/283 |

*Primary Examiner*—Albert J. Makay
*Assistant Examiner*—Carl Rowold
*Attorney, Agent, or Firm*—Wenderoth, Lind & Ponack

[57] ABSTRACT

The device comprises a support such as a railway tie defining a projecting shoulder on each side of a support table for the rail. An insulating clip has a body cooperating with the shoulder and a nose portion bearing against the flange of the rail. An elastically yieldable strip is superimposed on the clip and a fixing bolt extends through apertures in the clip body and the strip. The clip body has, on the side of the body remote from the nose portion, a heel portion which defines two surfaces which bear respectively against a lower support surface of the support and against the shoulder. The clip body defines in the center part an upper surface which is substantially parallel to the strip. Beyond a predetermined tightening force the additional force is transmitted to the support through the body and the heel portion of the clip.

12 Claims, 3 Drawing Figures

SPRING RAIL CLIP WITH TIGHTENING LIMITING FEATURE

The present invention relates to an elastically yieldable rail fixing and supporting device which ensures the electric insulation of the rail on its support.

Experience has shown that rail fixing devices must not only perform their main function, namely to maintain the rail elastically on its support, in both the vertical and transverse directions, but also satisfy the two following requirements:

1. When mechanically laying the railway track by modern methods, mechanical screw tighteners are employed for fastening the screw-spikes fixing the rails. These machines usually comprise a torque limiter which stops the tightening when the tightening force reaches a preadjusted value. But, in practice, this regulation is difficult to achieve, in particular since the torque due to the friction of the screwing varies. There is therefore a real danger of an excessive tightening which creates a risk of seriously deteriorating the elastically yieldable fasteners, and in particular, producing a permanent deformation of the spring strips which are then no longer effective.

It is therefore desirable that an elastically yieldable fastener be capable of withstanding without harmful effect a bolt tightening torque which is for example at least twice the "normal" tightening torque. This condition is not satisfied by the devices employed at the present time.

2. A rail support must, above all if it concerns a concrete sleeper or tie of a single mass-produced type, p e r m i t the laying of rails of different sections which are light or heavy, depending on the amount of traffic, at various distances apart, depending on the curvature of the track.

Consequently, the exact position that the flange of the rail must occupy cannot be defined by the sleeper or tie itself, as distinguished from the laying on wood sleepers or ties where the shoulders are produced "to measure" so that each rail section may be exactly positioned to suit the prescribed track width.

It is therefore particularly advantageous, above all when the rail is layed mechanically, to have available rail fixing components which may be placed in advance on the sleepers or ties and are capable of ensuring the precise transverse positioning of the rail and constitute lateral abutments or guides for the flange of the rail.

An object of the present invention is to provide a rail fixing device which is elastic and insulating and effective and competitive as concerns the price and which moreover facilitates the laying and regulation of the track and its adaptation to existing sleepers or ties designed to receive other fixing means.

According to the invention, there is provided a fixing and supporting device for a railway rail comprising a a support defining a support table for the rail and a projecting shoulder on each side of said table, a pad interposed between the rail and the support table, an insulating clip having a body cooperative with the shoulder and a nose portion bearing against the flange of the rail, at least one elastically yieldable strip, and fixing means extending through apertures of the body of the clip and the strip, wherein the body of the clip comprises, on the side thereof opposed to the nose portion, a heel portion defining two surfaces which bear respectively against a lower support surface of the support and against the shoulder, the body of the clip defining in its center part an upper surface which is roughly parallel to the strip, the arrangement being such that, beyond a predetermined tightening force, the additional force is transmitted to the support through the body and the heel portion of the clip.

According to other features:

The elastically yieldable strip bears mainly against the nose portion of the clip and against the upper support surface of the support near to the shoulder.

The body of the clip has at its upper end, adjacent the shoulder of the support, a recessed part, for example a chamfer.

In one embodiment, the clip bears against an intermediate member which may have an L-shape and which in this case has a roughly vertical branch interposed between the vertical support surface of the sleeper and the adjacent surface of the body of the clip.

the body of the clip comprises in its lower part a recess for receiving a lateral extension of the insulating pad on which the rail bears.

the projecting dihedron formed by the shoulder of the support has a shape similar to that of the rail flange.

The invention will be described in more detail with reference to the accompanying drawing, which is given solely by way of example and in which.

Figure 1:
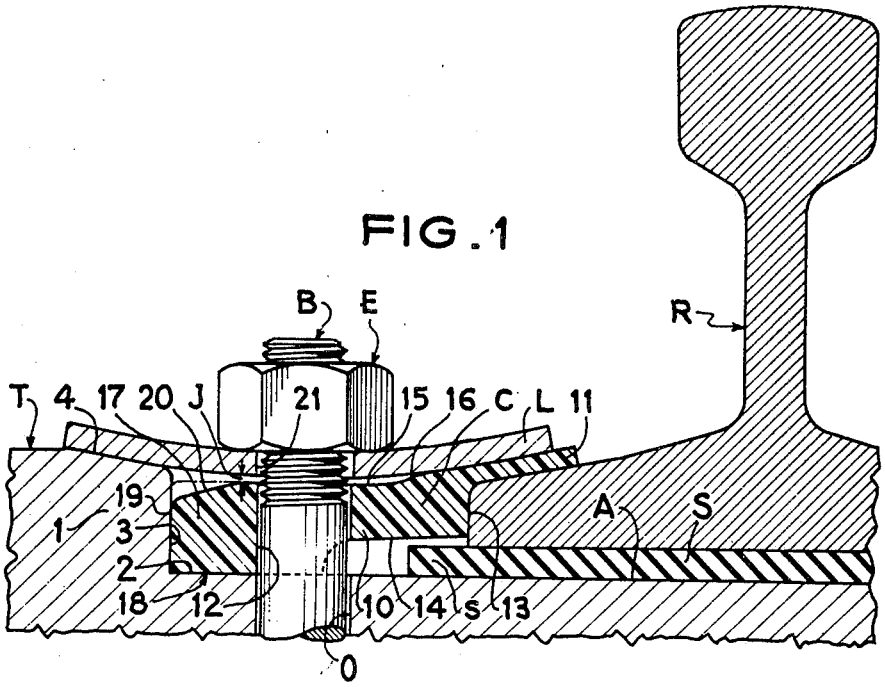
FIG. 1 is a partial diagrammatic sectional view of a device according to the invention.

As can be seen in FIG. 1, a device for supporting and fixing a rail R comprises a support which may be a concrete sleeper or tie T defining a support table A for the rail. A pad S is interposed between the rail and the table. On each side of this table the support has apertures or passageways O for the passage of fixing means such as a bolt B which may be tightened by a nut E.

The support also defines, on each side of the rail and outside the region of the apertures O, a projecting shoulder 1. In the vicinity of this shoulder there are thus defined a lower support surface 2, preferably in the same plane as the support table, a roughly vertical support surface 3, and an upper support surface 4 preferably roughly at the level of the rail flange. The projecting dihedron formed by the surfaces 3 and 4 has preferably the same shape as the rail flange.

The fixing means or device also comprises a clip C of an insulating material, for example a strong thermoplastic resin, and at least one elastically yieldable strip L of spring steel.

The clip has a body 10 from which extends a nose portion 11 which bears against the rail flange. This body is provided with an aperture 12 for the passage of the bolt and has the following features. Adjacent the rail, it defines a roughly vertical support surface 13 and a recess 14 accomodating an extension *s* of the pad S so as to lengthen the leakage lines and obtain a high degree of insulation between the rail and the support.

On its upper surface, the body of the clip has in its median part a planar or slightly curved surface 15 which is roughly parallel to the adjacent metal strip L. This flat region is connected to the nose portion 11 by a transition region 16 having a slope. The body of the clip also forms a heel portion 17 having a lower surface 18 in contact with the lower support surface of the support and a lateral support surface 19 in contact with the vertical support surface of the support. This heel portion is preferably slightly recessed in its upper part by a chamfer 20 but may also have the shape shown in dot-dash line (FIG. 1).

The strip is preferably planar in the free state and curved when the nut is screwed down along the bolt. It is provided with an aperture 21 for the passage of the bolt B and extends, by forming a bridge, between the nose portion 11 of the clip C bearing on the flange of the rail R and, at the other end, the upper surface 4 of the shoulder 1 which is located, apart from the thickness of the nose portion 11, roughly at the same level as the flange of the rail.

The nut E screwed on the bolt B exerts on the strip L a tightening or clamping force which elastically bends the strip L. The measurement of the gap J, between the lower surface of the strip L and the upper substantially horizontal plane 15 of the clip C in the region of the axis of the bolt B, permits ascertaining the intensity of the tightening. The dimensions of the rail components are so chosen as to obtain the desired tightening force, which can be withstood without damage, at the moment when the clearance J is eliminated.

If there is an attempt to continue to tighten the nut E thereafter, the tightening torque increases suddenly and considerably and this actuates the torque limiter of the screwing device. Indeed, the lower surface of the strip L then bears against the upper surface 15 of the clip C whereas the lower surface 18 of this clip which bears against the support T at 2, constitutes a direct and solid abutment. This abutment is provided by a large surface which at least partly surrounds the aperture O.

Owing to this arrangement, any excessive tightening is transmitted to the support T through the body C of the clip which is then subjected to a simple compression. This "safety" abutment produces in the body of the clip C neither a bending moment nor a shearing stress and consequently enables it to withstand high forces without notably deforming or breaking. The spring strip L is thus effectively protected against excessive tightening forces, whereas it is well known how much the known elastically yieldable fasteners comprising at least one spring strip tightened down by screwing, are criticized owing to their vulnerability under an excessive tightening force and the attention they require for this reason when laying and holding down the rail.

It should be mentioned that the fixing device according to the invention is also capable of withstanding high lateral forces from the rail, and in particular the forces of leading and guiding vehicles into the bends in the railway track, without suffering therefrom and with no danger of breaking the shoulder 1 if it is of concrete. Indeed, the body of the clip C is then subjected to simple compressive stresses between substantially vertical surfaces 13 and 19. These forces are transmitted to the shoulder 1 on its substantially vertical surface 3. But the projecting dihedron of the shoulder is at the same time subjected on its substantially horizontal surface 4 to a permanent vertical elastic force on the part of the end of the spring strip L. These forces are substantially orthogonal and have a resultant which is inclined toward the mass of the support T and there is no danger of bursting the shoulder 1 as would otherwise be the case when the vertical surface 3 is alone subjected to the forces.

With regard to the vertical forces transmitted by the heel portion 17 of the clip C to the table of the sleeper or tie T in the case of an excessive tightening, they have no harmful effect on the support since the concrete has a particularly high strength under compression. They even have a surprising beneficial effect of balancing the upward reaction of the head of the bolt B (not shown) if the latter is anchored in the concrete.

Figure 2:
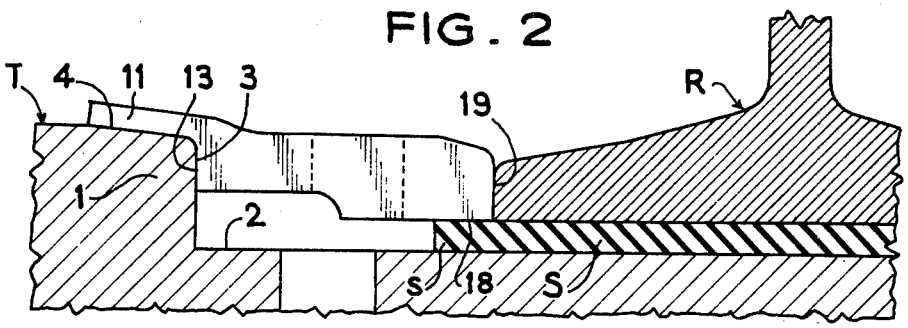
FIG. 2 illustrates an intermediate stage in the laying of the rail.

FIG. 2 reveals another advantage of this device.

FIG. 2 shows the rail R bearing on the support T through the pad S which extends beyond the flange of the rail at *s*. The clip C is placed in a position located in a plane rotated through 180° with respect to the normal position shown in FIG. 1. In this reverse position, the clip C bears through its nose portion 11 against the shoulder around which it fits as though it concerned the edge of the rail flange. The rear heel portion bears on the projecting portion *s* of the pad S. The substantially vertical surface 19 of the heel portion of the clip C constitutes a lateral abutment for the rail flange which is thus positioned at the same distance from the vertical surface 3 of the shoulder 1 as is the clip when placed in its normal position.

The clip C may be mounted on the support T in the position shown in FIG. 2 before the rail R has been brought in position. Indeed, nothing opposes the descent of the rail R down along the lateral abutment 19 or between the two corresponding abutments constituting guides if the corresponding clip (not shown in the Figure) is also previously mounted in reverse on the other side of the rail.

After the rail has been placed in position on the sleepers or ties which are thus easily aligned, it is sufficient to turn the clips around and to mount the strips and bolts to terminate the laying of the track.

The clips C of each sleeper, or some thereof, may also be put in this reverse position, after disassembly, to guide the rail, which is slightly raised on rollers, when it is desired to release the stresses or ensure the regulation of its length in accordance with the conventional methods employed for long welded rails.

Figure 3:
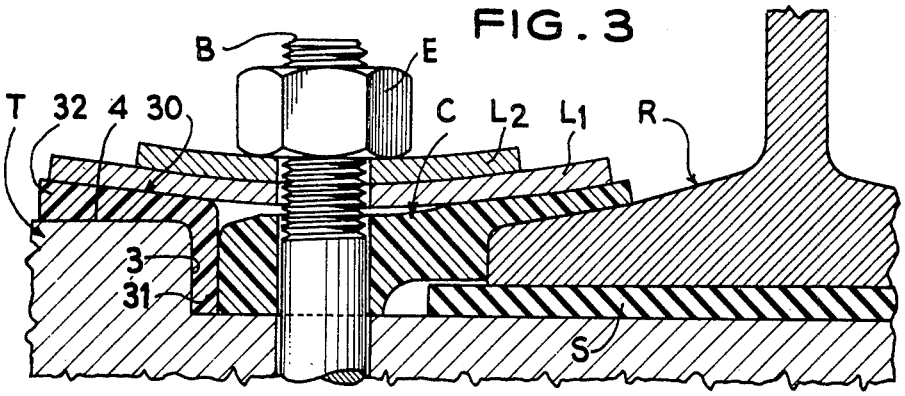
FIG. 3 is a view similar to FIG. 1 of a modification.

FIG. 3 gives by way of an example, to which the invention is not intended to be limited, a modification of the invention which is slightly more complex but which permits the adaptation of the fixing device according to the invention to a support, for example a concrete sleeper or tie, which has been prepared or moulded for receiving fixing devices of a different type.

Apart from the components already described and designated by the same letters or reference numerals, the fixing device comprises :

an additional spring strip $L_2$ placed above the main spring strip $L_1$. Its purpose is to permit the fixing device to support higher forces, in particular if the distance between the lateral surface of the flange of the rail R and the vertical surface 3 of the shoulder 1 is large, without adversely affecting its flexibility, in accordance with the well-known principle of multiple spring strips or leaf springs, an intermediate member 30 having the shape of a L-section member having two flanges 31 and 32 which bear respectively against the similar surfaces 3 and 4 of the shoulder 1.

This intermediate member 30 performs a double function :

It permits a correction of the geometry of the shoulder 1, in particular for adapting it to rails having different sections. In particular, FIG. 3 shows a wedge-shaped flange 32 of variable thickness which provides the strip L, which bends under the effect of the tightening of the bolt B, a uniform support, whereas the upper surface 4 of the shoulder is parallel to the support table of the support T.

Secondly, it avoids the direct rubbing of the steel strip L on the concrete if it concerns a concrete sleeper. This direct rubbing between steel and concrete could finally produce a wear corrosion. This member 30 also avoids rubbing between the surface 19 of the heel portion of the clip C and the shoulder 1.

It is therefore preferably made from a synthetic material which resists both high compression and wear. It is advantageously adhered to the shoulder 1 in the factory producing the concrete sleepers. This adhesion if it is produced in a fixture, permits correcting the lack of precision or unevenness of the moulding of the shoulder which defines the precision of the track width.

A simplified modification of the member 30 (not shown) may consist of a simple plate performing the function of a substantially horizontal flange 32 of the member 30, the substantially vertical flange 31 being eliminated. This plate may then be advantageously adhered or riveted by ultrasounds to the end of the spring strip L so as to avoid losses and facilitate the laying of the track.

It is essential to note that in these various embodiments the shape of the clip permits obtaining the following fundamental results : it is only when the tightening force exerted by the strip, constituting a bridge between the support and the rail, exceeds its desired value that the body of the clip C is compressed between the support and the strip. Moreover, even under these conditions, none of the elements of the fixing device is subjected to stresses liable to damage it or impair the safety of the maintenance of the rail. Note also that in the various embodiments, the clip permits the correct positioning of the rail with no additional means.

Having now described my invention what I claim as new and desire to secure by Letters Patent is:

1. In a device for fixing and supporting a rail of a railway track which rail has a flange, comprising a support having a first portion defining a support table for the rail and second portions each having an upper surface higher than said table and defining a shoulder which extends upwardly from said support table at opposite ends of the support table, a pad interposed between the rail and the support table, an insulating clip having a body which is interposed between the shoulder and the flange and defines an aperture and a nose portion bearing against the flange of the rail, at least one elastically yieldable strip defining an aperture and placed on top of the clip to extend over the clip, the nose portion being interposed between the strip and the flange and the strip being located to be supported by said upper surface of one of said second portions, and fixing means extending through the apertures in the body of the clip and the strip for fixing the strip and clip to the support, the body of the clip comprising, on a side thereof opposed to the nose portion, a heel portion defining a first surface which faces toward said table and a second surface which is supported laterally against the shoulder, the body of the clip defining substantially in a center part thereof and upper face which is substantially parallel to the strip; the improvement wherein at least a part of said first surface is located so that it at least partly surrounds said aperture of the clip and is in abutting relation to said table, the arrangement being such that, beyond a predetermined tightening force exerted by said fixing means on the strip, the additional force is transmitted to the support through the body and the heel portion of the clip and said first surface of the clip and said table of the support.

2. A device as claimed in claim 1, wherein the body of the clip has at an upper end, adjacent the shoulder of the support, a recessed portion.

3. A device as claimed in claim 1, wherein the pad is an insulating pad and has a portion extending laterally beyond the rail flange and the body of the clip has in a lower part thereof a recess capable of receiving the lateral extension of the pad.

4. A device as claimed in claim 1, wherein the strip is in direct contact with said upper surface of said one second portion.

5. A device as claimed in claim 1, comprising an intermediate member between said upper surface and the strip.

6. A device as claimed in claim 5, wherein the intermediate member has two branches arranged in an inverted L shape, one of said branches being substantially vertical and interposed between the shoulder of the support and an adjacent surface of the body of the clip.

7. A device as claimed in claim 5, wherein the intermediate member has a wedge shape.

8. A device as claimed in claim 1, comprising two superimposed elastically yieldable metal strips, the lower strip being longer than the upper strip.

9. A device as claimed in claim 1, wherein the shoulder defines a projecting dihedron whose shape is similar to the shape of the flange of the rail.

10. A device as claimed in claim 1, wherein the shoulder has an upper surface which is substantially at the same level as the flange of the rail.

11. A device as claimed in claim 1, wherein said first surface surrounds a major part of said aperture of the clip.

12. A device as claimed in claim 1, wherein said first surface completely surrounds said aperture of the clip.

* * * * *